US010058829B2

(12) United States Patent
Ladd et al.

(10) Patent No.: US 10,058,829 B2
(45) Date of Patent: Aug. 28, 2018

(54) STATIC MIXER MANIFOLD

(71) Applicants: Jason Ladd, Mansfield, TX (US); Darrell Mitchell, Mansfield, TX (US)

(72) Inventors: Jason Ladd, Mansfield, TX (US); Darrell Mitchell, Mansfield, TX (US)

( * ) Notice: Subject to any disclaimer, the term of this patent is extended or adjusted under 35 U.S.C. 154(b) by 189 days.

(21) Appl. No.: 14/919,283

(22) Filed: Oct. 21, 2015

(65) Prior Publication Data

US 2017/0113195 A1 Apr. 27, 2017

(51) Int. Cl.

| | |
|---|---|
| ***B01F 5/00*** | (2006.01) |
| ***B01F 5/06*** | (2006.01) |
| ***B01F 15/00*** | (2006.01) |
| ***B01F 15/02*** | (2006.01) |

(52) U.S. Cl.

CPC ..... *B01F 5/0659* (2013.01); *B01F 5/0679* (2013.01); *B01F 15/0224* (2013.01); *B01F 15/0297* (2013.01); *B01F 5/0082* (2013.01); *B01F 15/0226* (2013.01); *B01F 2005/004* (2013.01); *B01F 2005/0045* (2013.01); *B01F 2005/0091* (2013.01); *B01F 2215/0081* (2013.01)

(58) Field of Classification Search

CPC .. B01F 5/0659; B01F 5/0679; B01F 15/0224; B01F 15/0297; B01F 2005/0045; B01F 2005/0091; B01F 5/0082; B01F 2005/004; B01F 15/0226; B01F 2215/0081

USPC ..... 366/167.1, 173.1, 173.2, 174.1, 175.2, 366/177.1, 340

See application file for complete search history.

(56) References Cited

U.S. PATENT DOCUMENTS 1,496,345 A * 6/1924 Lichtenthaeler ..... B01F 5/0451 366/147
1,676,237 A * 7/1928 Baker ..... F02M 1/00 138/92
1,698,432 A * 1/1929 Erickson ..... B01F 5/0659 196/46
1,733,545 A * 10/1929 Leaver ..... B01F 5/0659 196/46

(Continued)

*Primary Examiner* — Tony G Soohoo

(74) *Attorney, Agent, or Firm* — James Robert (Jim) Johnson

(57) ABSTRACT

This invention is a low pressure, steady volume supply static mixer manifold for a high pressure pump. The design comprises an internal diffuser cylindrical tube inside an external rectangular tube in which static mixing occurs. Capped at one end, the internal diffuser pipe, with flow coming from the opposite side, allows for one flow direction diffused into the outer rectangular tube that then allows for constant bidirectional flow at a constant pressure throughout. The flow of slurry components between the cylindrical tube and the rectangular tube supports static mixing in part by creating alternating flow pressures between mixing ports (allowing flow of slurry components from the cylindrical tube) and the exit ports based on the different geometries of the cylindrical tube and rectangular tube. The combination of flow and pressure exiting the cylindrical tube through the mixing ports, at an angle to the bottom corners of the outer rectangular tube, creates a natural agitation of the slurry components. The cutouts in the inner tube are sized and spaced for providing the proper flow, mix, and pressure to each exit port.

16 Claims, 15 Drawing Sheets

(56) References Cited

U.S. PATENT DOCUMENTS 2,304,248 A * 12/1942 Entwistle ..... B01D 21/02 210/519
2,355,305 A * 8/1944 Koenig ..... B01D 21/02 210/519
2,740,616 A * 4/1956 Walden ..... B01D 11/043 181/264
2,777,467 A * 1/1957 Powell ..... B01F 5/0659 138/37
2,784,948 A * 3/1957 Pahl ..... B01F 5/0451 198/657
3,166,382 A * 1/1965 Purse ..... B01D 53/944 181/276
3,190,618 A * 6/1965 Katzen ..... B01F 5/0619 366/337
3,207,484 A * 9/1965 Rubin ..... B01F 5/0659 220/568
3,475,508 A * 10/1969 King ..... B01J 8/0214 422/198
3,802,668 A * 4/1974 Charles-Messance .. B01F 5/061 366/336
3,814,262 A * 6/1974 Nolley, Jr. ..... B01D 17/0208 210/519
3,818,938 A * 6/1974 Carson ..... B01F 5/0405 239/427.5
4,043,539 A * 8/1977 Gilmer ..... B01F 5/0659 138/42
4,189,243 A * 2/1980 Black ..... B01F 5/0659 366/336
4,344,844 A * 8/1982 Townley ..... B03B 1/04 209/1
4,564,142 A * 1/1986 Cleer, Jr. ..... F24D 3/1066 237/56
4,913,819 A * 4/1990 Patterson ..... B01D 21/2466 134/166 R
5,316,384 A * 5/1994 Corso ..... B01F 5/045 137/896
5,333,952 A * 8/1994 Perdue ..... B01F 5/0659 366/336
5,375,654 A * 12/1994 Hougland ..... F28F 13/12 138/38
5,474,102 A * 12/1995 Lopez ..... F16L 41/03 137/271
5,613,510 A * 3/1997 Proctor ..... B08B 9/093 134/166 R
5,793,831 A * 8/1998 Tsiklauri ..... F01K 3/181 137/888
5,950,575 A * 9/1999 Simons ..... F24D 3/1066 122/511
6,062,308 A * 5/2000 Flood ..... E21B 36/00 137/602
6,123,108 A * 9/2000 Chen ..... F16L 55/041 138/30
6,779,786 B2 * 8/2004 Ruscheweyh ..... B01F 5/0451 261/79.2
7,041,218 B1 * 5/2006 Liles ..... B01F 5/0646 209/434
7,509,927 B2 * 3/2009 Mukomilow ..... F24D 3/1066 122/235.15
8,404,189 B2 * 3/2013 Andresen ..... B01F 3/02 239/429
8,834,016 B1 * 9/2014 Richie ..... B01F 5/0062 366/134
9,194,526 B2 * 11/2015 Lindstrand ..... F24H 1/181
D747,361 S * 1/2016 Franklin ..... D15/5
9,352,251 B2 * 5/2016 Seifert ..... B01D 21/2416
2013/0128688 A1 * 5/2013 Doolin ..... B01F 5/0268 366/163.2
2016/0250606 A1 * 9/2016 Nasman ..... B01F 5/0065 366/173.1
2017/0095780 A1 * 4/2017 Richie ..... B01F 5/0618
2017/0113195 A1 * 4/2017 Ladd ..... B01F 5/0659

* cited by examiner

SECTION A-A

SECTION B-B

STATIC MIXER MANIFOLD

BACKGROUND OF THE INVENTION

The present invention is directed to a low pressure, steady volume manifold suitable to deliver a multi-component working fluid to a high pressure pump for use in oil field operations and the static mixing of multi-component fluids used therein. Fluid components, whether mixed, partially mixed or unmixed, are delivered under low pressure into a core cylindrical tube. Angled cut-out mixing ports allow the fluid to flow to an outer rectangular tube. The combination of the directed flow of the fluid through the angled cut-out ports of the cylindrical tube into the rectangular outer tube, pressure imposed on the fluid and the different geometries in the volume of spacebetween the cylindrical tube and the rectangular tube produce natural turbulent mixing without the use of moving parts to mix the working fluid components.

BRIEF DISCUSSION OF THE RELATED ART

The present invention introduces a design optimization which serves to meet a critical and pervasive need in the oil and gas drilling and extraction industry. Despite the extensive level of work currently underway in the field of horizontal drilling and fracturing (or "fracking") in oil and gas extraction, few technological advances have been made to optimize the design and functionality of low pressure suction manifolds. These parts are system components for pumping fracking fluids (slurries) into wells to create and maintain fractures necessary for the extraction of oil and natural gas.

Fracking fluids are typically viewed as slurries composed of water, sand and special duty chemicals or compounds designed to create fractures and prop them open to facilitate the flow of oil and gas to the surface.

The fracking fluid is typically 90% to 99% water. The majority of the remainder is a proppant. The proppant serves the function of holding open cracks and fractures introduced into the well by the pressure created by the fracking fluid. Chemical additives typically comprise less than 1% to a few percent of the total fracking fluid. These chemical additives, while comprising only a small proportion of the final product, typically serve essential functions. For example, acids (hydrochloric or muriatic) may be used to break down rock components and aid crack formation. Antibacterial agents and corrosion inhibitors may be used to help extend the life of the well. Gels, such as guar gum, may be used to thicken the water to help keep the proppants suspended.

Fracking fluids are often used on the order of millions of gallons per site. Large volumes of fracking fluids are necessary both to counter the pressure atop the producing formation, which may be 10,000 feet or more below the surface, as well as to produce fractures in a large enough volume of formation to make production profitable.

Critical to the effort at this scale is the need to eliminate the collection or creation (via caviation) of fluid voids within one or more of the fluid end chambers caused by slow delivery of fracking fluid to these chambers and to keep proppants and additives well mixed in the fracking fluid. Fluid voids cause pressure imbalances between different pistons, resulting in systemic vibrations and can lead to equipment failure. Further, in order to fracture successfully, proppants and chemical additives must be evenly distributed throughout the fracking fluid. Current technologies include various mechanical mixers, pressure inducing devices, blenders and agitators designed to stir, shake, or otherwise move the components sufficiently to cause them to mix, disperse or remain suspended. However, these often fail to overcome the tendency of the components to settle out. Further, current technologies, being based on mechanical efforts to mix, blend and agitate, typically require high levels of maintenance, repair and replacement.

While technological advances have been made to improve the overall efficacy of the fracturing process, numerous improvement opportunities at the component level within the system remain. Although fracking has been used in oil, gas and coal production for more than 60 years, it has mostly been overlooked in terms of government and corporate research to improve either the system as a whole or the components of it (other than the fracking fluid itself). The combination of out-dated technologies and the mechanical nature of these current technologies to mix and pump fracking fluid components results in high maintenance costs, higher labor costs and additional time required to bring a well on-line.

Fracking operations commonly involve both vertical (conventional) and horizontal (unconventional) drilling across a production field in which multiple segments are drilled off a single borehole on a horizontal plane. Each segment may he further divided into multiple perforation clusters. In a given field, multiple horizontal boreholes are drilled. The large-scale nature of the operation results in the need for large volumes of fracking fluid, which enters the high pressure pump sufficiently mixed to perform its role immediately and effectively and with a minimum of down time. Mechanical means can typically perform at a high level, but come at the cost of requiring regular maintenance or are subject to breakdown. As a result, current technologies are less efficient at meeting the demands of the oil and gas industry.

There is a need for a device which can mix fracking fluid components while minimizing the amount of mechanical effort needed to mix these components. There is a further need for a device which can deliver fracking fluid, which has been suitably mixed, at rates necessary to supply a drilling operation. There is a further need for a device which can optimize the delivery of fracking fluid to a high pressure reciprocating pump while avoiding the fluid voids that result in pump degradation, cavitation, and vibrational energy loss. The present invention meets these needs.

SUMMARY OF THE INVENTION

While the present invention is described in terms of the mixing of slurries used in oil field operations, it should be understood that the present invention is useful in any field in which the static mixing of materials under pressure is an element. Further, while the invention is described in terms of the embodiments presented, the invention encompasses all configurations of the invention possessing the essential features of the invention as disclosed herein. For the purpose of this disclosure, the term "fracking fluid" refers to any combination of water (or similar fluid) and sand (or similar proppant), and optionally combined with one or more special purpose chemicals.

In a preferred embodiment, the invention comprises a multi port manifold in which an elongate hollow cylindrical tube (the "cylindrical tube") is affixed to and within an elongate hollow rectangular tube. The cylindrical tube further comprises a standard flange which can be mated to an appropriate flange mounted on the rectangular tube (the "rectangular tube"). Imagining each of the tubes as open ended tubes, the flange and flange mount are affixed to one end of each open tube. The other end of each tube is capped. The tubes may be affixed to one another at the flange by welding, bolts or similar secure method, Generally in this specification, tubular parts will be described in Cartesian coordinates, although the cylindrical tube may be described in cylindrical dimensions.

The cylindrical tube has a diameter smaller than the smaller of the vertical or horizontal dimension of the rectangular tube. The length of the cylindrical tube along the long axis is slightly shorter than the length of the rectangular tube along its long axis, so that the cylindrical tube may fit entirely inside the rectangular tube. The cylindrical tube, further, has an inside and an outside. The cylindrical tube has a longitudinal axis and a diameter, each of which are typical of known cylindrical tubes. The tubes are affixed to each other offset from center vertically along the negative vertical axis and centered horizontally along the longitudinal axis to improve flow symmetry outside of the cylindrical tube and inside the rectangular tube during operation.

Through the wall of the cylindrical tube are disposed, generally by cutting, a plurality of shaped, positioned and sized ports (the "mixing ports") to allow fluid flow out from the interior of the cylindrical tube into the outer area of the cylindrical tube and within the inner area of the rectangular tube. The walls of the cylindrical tube are sufficiently thick and durable, and may be lined with a proprietary coating that is wear-resistant enough to withstand the pressure and abrasiveness of the materials pumped through it.

Similarly, a plurality of ports (the "exit ports") are cut into or otherwise disposed on the rectangular tube. The rectangular tube has a longitudinal axis, a vertical axis and a horizontal axis. The rectangular tube also has an inside and an outside. Further, the walls of the rectangular tube are sufficiently thick and durable enough to withstand the pressure and abrasiveness of the materials pumped through it. The interior surfaces of the rectangular tube may be coated with a coating designed to improve fluid flow within the rectangular tube. The tubes are configured for attachment such that the mixing ports of the cylindrical tube are approximately diametrically distant relative to the exit ports of the rectangular tube. As such, in practice, if the mixing ports of the cylindrical tube are disposed towards the bottom of the cylindrical tube on the invention, the exit ports of the rectangular tube are disposed on the top of the rectangular tube of the invention. This requires fracking fluid flowing through the invention to remain in the invention longer and to flow symmetrically from the cylindrical tube mixing ports bisecting equally and flowing down to the corners of the rectangular tube and then flowing up and out through the rectangular tube exit ports.

The mixing ports of the cylindrical tube are designed to prevent the majority of the fracking fluid flowing out of the cylindrical tube through the mixing ports into the rectangular tube from exiting the cylindrical tube in the negative vertical axis direction. Instead, the mixing ports are angled and express bilateral symmetry so as to cause the fracking fluid to flow out of the cylindrical tube and into the rectangular tube at a predetermined angle off the negative vertical axis of the cylindrical tube in two directions (specifically the positive and negative horizontal directions relative to the longitudinal axis of the cylindrical tube, although some amount of flow in the negative vertical axis direction may be specifically allowed or intended). The cylindrical tube mixing ports are sized, spaced and angled to produce a predetermined amount of flow, mix and pressure through each cylindrical tube mixing port. Further, mixing ports are shaped to optimize turbulent flow after the fracking fluid flows out of the cylindrical tube and into the rectangular tube.

The exit ports of the rectangular tube are generally aligned on the top horizontal surface of the rectangular tube. All of the exit ports on a single side of the rectangular tube are aligned and generally centered on the top of the rectangular tube in such spacing and dimensions as to meet up with and connect to the fluid end of a reciprocating pump for well injection. Generally, three or five exit ports are disposed in the invention.

In practice, a low pressure supply pump is used to feed fluid fracking fluid components to the manifold. The fracking fluid components may be mixed, unmixed or partially mixed prior to entry into the supply pump. The supply pump feeds the fluid fracking fluid components into the inside of the cylindrical tube. As the materials pass through the inside of the cylindrical tube, some amount of the materials exit the inside of the cylindrical tube at some predetermined angle off the radial axis of the cylindrical tube through each of the mixing ports on the cylindrical tube and into the inside of the rectangular tube. The cylindrical tube mixing ports are sized and angled based on known characteristics of the pumping operation, such as the fracking fluid components used, pressures required and volume of materials.

As a result of the different geometries of the cylindrical tube and the rectangular tube, as the materials flow at an angle out of the cylindrical tube, they are forced into the rectangular geometry of the rectangular tube, pressing the materials into the bottom corners of the rectangular tube. This geometrical difference combined with the pressures placed on the fracking fluid components, the different bulk modulus of the various components, the motion of the components and other factors in the system results in the introduction of turbulence, causing the fracking fluid components to mix and keeping the proppants in suspension.

This property of mixing components compares to static mixing, known in other art, in which separate or separated materials, usually fluid components, are caused to be flowed past a static mixer, inducing turbulent or non-laminar flow. The resultant turbulent or non-laminar flow thereby mixes the components. Known static mixers typically have a planar or helical design. A planar design may induce a pressure differential in the fluid components which induces non-laminar flow. A helical static mixing directly creates non-laminar flow by the impingement of the fluid components on the helix and redirection of the flow following impingement.

In the present invention, it is the shape of the flow volume between the inner cylindrical tube and outer rectangular tube which induces turbulent or non-laminar flow. The present invention can be seen as a substantive improvement over current static mixing devices.

Further, by comparison, known manifolds, such as disclosed in U.S. Pat. No. 7,621,728 (the "'728 patent"), may use a design of a cylindrical tube inside a larger diameter cylindrical tube. In the '728 patent, the inner cylindrical tube comprises an expandable resilient material which expands or contracts to stabilize pressure in the manifold. Mixing may be undertaken within the manifold, albeit with significantly less efficiency than the present invention, in such a manifold, no such resultant turbulence is seen.

In the present invention, turbulent flow and equalized pressures are seen consistently in the space between the cylindrical tube and the rectangular tube. As a result, the exit ports of the rectangular tube are fed tracking fluid at a consistent rate and composition. It is seen in the current art that inconsistent feeding of fracking fluid to the exit ports of a manifold and into the fluid end of a reciprocating pump which pumps fracking fluid into the well leads to problems with pumping, such as fluid voids in one or more fluid chamber. These fluid voids result in, among other things, cavitation, systemic vibrations or varying pressures and fracking fluid composition of the fracking fluid being pumped. The present invention, by providing consistent rates of flow and fracking fluid composition to the exit ports of the rectangular tube and into the fluid end of the reciprocating pump, prevents these fluid voids. This reduces uneven pump component wear, as well as stress and failure, and increases the longevity of the associated parts of the pump system, specifically the fluid end and its internal component parts. Further, the prevention of these dissipative operational elements reduces energy costs as well as down time for maintenance and repairs.

The exit ports of the rectangular tube are fed fracking fluid in a predetermined pattern. Where five ports are used, with the ports numbered sequentially along the length of the rectangular tube from one to five, the ports might be fed in the pattern of 1-5-3-2-4. In the present invention, this pattern, combined with the inherent turbulence of the system between the cylindrical tube and the rectangular tube, prevents the creation or existence of any stagnant flow regions of fracking fluid—that is, any locations where fracking fluid remains generally motionless in the manifold rather than moving through to the reciprocating pump. Stagnation typically results in suspended components settling out of the fracking mixture and accumulating within the manifold, negatively impacting performance.

In addition, the simple design of the invention does away with a need for means to maintain pressure within the manifold, such as by an elastomeric liner (e.g. the '728 patent). By reducing the number of moving parts, operational effectiveness is increased. Further, the simple design also reduces repair time in the event of breakdown.

As a result of the improvements created by the invention, all exit ports of the rectangular tube are fed an even and consistent amount of mixed fracking fluid, having both the desired level of mixing and the rate of flow-through required for effective high-pressure pumping. In the prior art, ineffective flow through the manifold typically results in one exit port experiencing fluid voids, having inconsistent pressure and a variable fracking fluid flow rate into the fluid end of the reciprocating pump compared with the other exit ports. As a result, fracking fluid is pumped into the bore hole at varying rates, pressures and fracking fluid composition, which reduces the effectiveness of the fracking operation and causes abnormal wear or destruction of the fluid end and its internal components. The present invention corrects these problems.

DETAILED DESCRIPTION OF THE DRAWINGS

Figure 1:
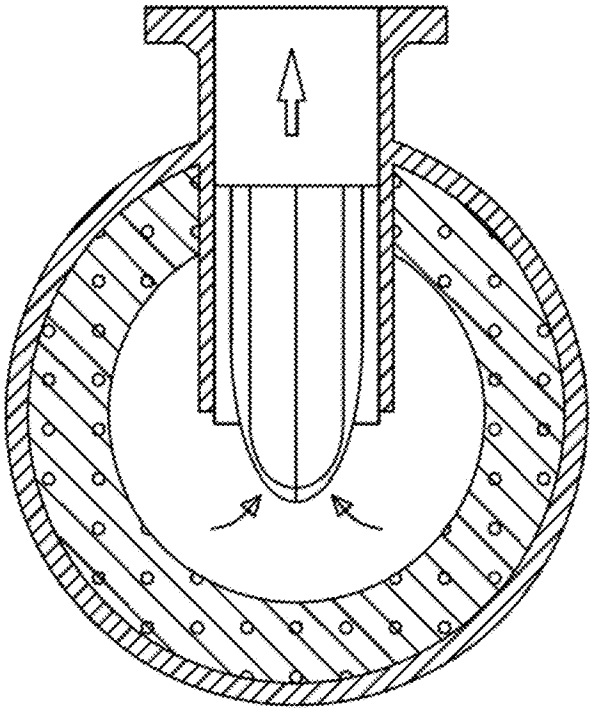
Prior Art FIG. 1
FIG. 1 depicts a cross-section of a manifold known in the art which uses a cylindrical tube with an elastomeric interior cylindrical liner.

Referring first to FIG. 1, a manifold design known in the art is depicted. The depicted cross-section is from FIG. 3 of U.S. Pat. No. 7,621,728 (the '728 patent). In this invention, a single cylindrical tube further comprises a closed-cell elastomeric inner liner which may expand or contract to help stabilize pressure within the cylinder during fracking operations. Reference should be made directly to the '728 patent for design details. To avoid confusion, numbering has been removed from FIG. 1. The '728 patent further comprises partition member which extends into the flow path central to the cylindrical tube allowing passage of the fracking fluid into the borehole. Without otherwise commenting on the '728 patent, it is noted that pressure stabilization is provided by the use of moving parts, which inherently weaken the system and require excessive maintenance and replacement as opposed to a system without moving parts.

Further to FIG. 1, mixing is performed in one of a plurality of vertical columns using known static mixing apparatus. However, because the fracking fluid is able to settle or separate prior to entry into one of the plurality of vertical columns, mixing efficiency is permanently compromised given that the fracking fluid can only be as good as the available components that reach a given vertical column for mixing.

Figure 2:
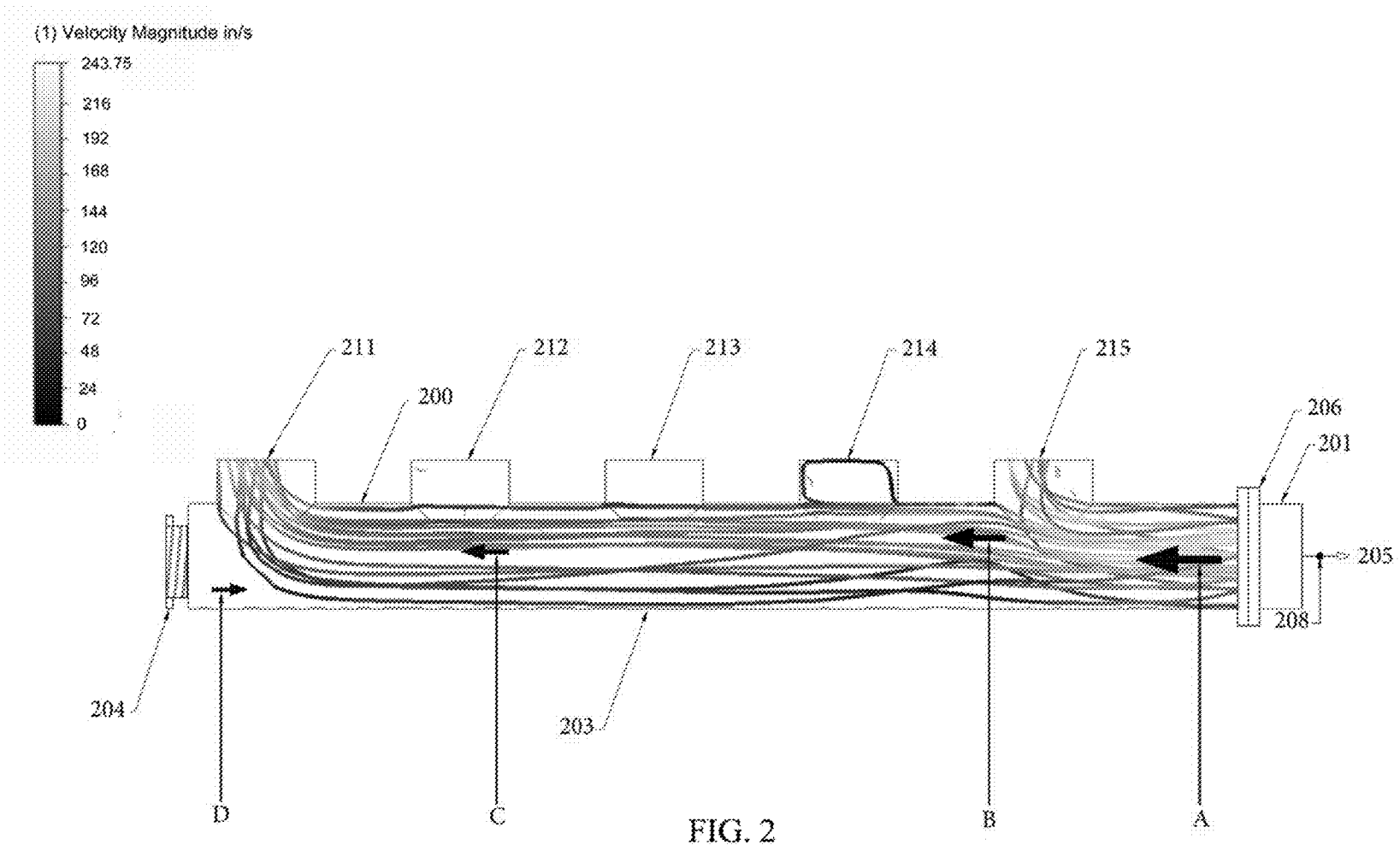
FIG. 2 depicts a perspective view of a computational representation of flow through a simple single cylindrical tube manifold known in the art.

Referring now to FIG. 2, a computational representation of a flow pattern through a typical manifold is depicted. In this FIG. 2, a representative manifold 200 is depicted. The body of the manifold 200 is a generally elongate cylindrical tube 203 having a longitudinal axis 205. On the distal end of the cylindrical tube 203, relative to the longitudinal axis 205 is an end cap 204 preventing through flow. On the proximal end of the cylindrical tube 203 is a feeder pipe 201 fixedly attached to the cylindrical tube 203 through a flange 206. The feeder pipe 201 extends into the interior of the cylindrical tube 203 approximately ⅕ to ¼ of the length of the cylindrical tube 203 (not depicted).

Along a line parallel to the longitudinal axis 205 imposed on the surface of the cylindrical tube 203 is a line of exit ports 211 through 215. The number of exit ports 211 through 215 depicted here is relatively arbitrary. One, two, three or five exits ports are known in the art, and the present invention does not modify this aspect. The exit ports 211 through 215 comprise cylindrical tubes of smaller diameter than cylindrical tube 203. Suitable approximately circular holes are cut through the cylindrical tube 203 with exit ports 211 through 215 fixedly attached over the holes. Exit ports 211 through 215 are suitably connected to a reciprocating pump (not depicted) for fracking operations. Each exit port 211 through 215 contains an integrated valve (not depicted) suitable to stop flow through the exit ports 211 through 215 during operation.

Figure 7:
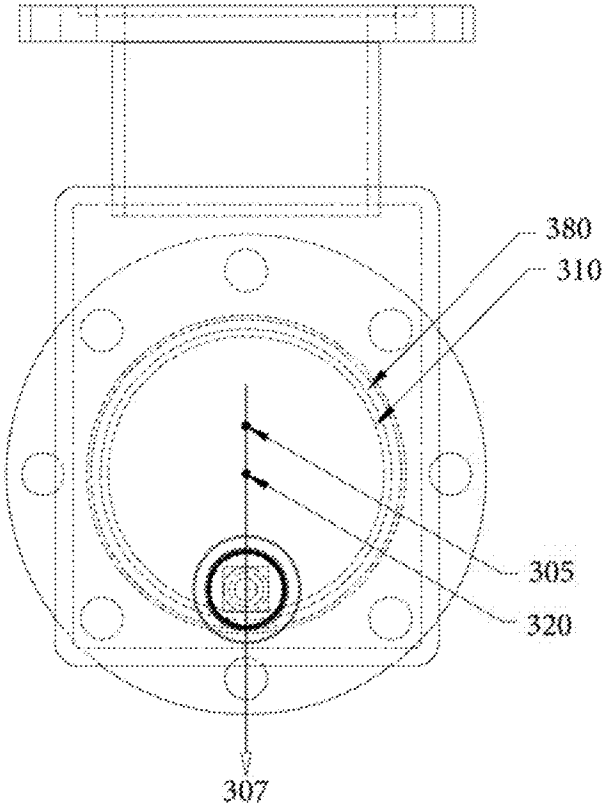
FIG. 7 depicts an end view of the proximal end of the invention showing the relative position of the cylindrical tube to the rectangular tube.

During operations, fracking fluid of standard composition is pumped through feeder pipe 201 into the cylindrical tube 203. Once in the cylindrical tube 203, the (racking fluid fills the interior of the cylindrical tube 203. The exit ports 211 through 215 are opened sequentially. Timing of the exit ports 211 through 215 is patterned, such as in the form of 211 then 215 then 212 the 214 then 213, thereafter repeating the pattern. Referring briefly to FIG. 7, such a pattern of timed opening and closing is depicted. Generally, two exit ports are open at any one time. While one exit port is opened, the next in the sequence is closed. Thereafter, the next pair in the sequence is opened and closed.

Referring now to the flow pattern of fracking fluid within the representative manifold, it is immediately clear that imbalances exist in the outflow. In FIG. 2, a high rate of outflow is seen through exit port 211 while only a small rate of outflow is seen through exit port 215, despite that both exit ports are identified as open. This flow imbalance is caused by the inefficiency of the manifold flow. The flow pattern within cylindrical tube 203 is seen as favoring flow above a plane located at the longitudinal axis 205 and perpendicular thereto along the horizontal axis out of the figure in the direction of axis 208. Below this plane, there is seen some back flow (arrow D) and regions of minimal or no flow 220. Of importance, rate of flow below the plane is markedly slower than above. Thus, in the bottom half of the manifold, fracking fluid is allowed to settle out. Further to this, the rate of flow, identified by arrow A, in the feeder pipe 201 drops off rapidly almost immediately upon entry into cylindrical tube 203, as reflected in arrow B. The rate of flow diminishes even further, although not as steeply, at the position reflected by arrow C. Backflow is depicted by arrow D. The relative size of each arrow indicates flow rate.

The unequal flow rates through different exit port leads directly to unequal fracking fluid volumes and pressures in the reciprocating pump and the borehole. As a result, the system experiences fluid voids, cavitation and disruptive vibration, each of which can lead to wear and breakdown of parts. Likewise, the settling out of fracking fluid allows the fracking fluid components to separate. The fracking fluid, as so pumped, becomes less effective down hole. Specifically, in some areas the fracking fluid will have a lower concentration of proppants and in places it will have a higher concentration. As a further result, in some areas of the formation, the formation will be over propped and in others it will be under propped. In each case, this can reduce the production of hydrocarbons.

Figure 3:
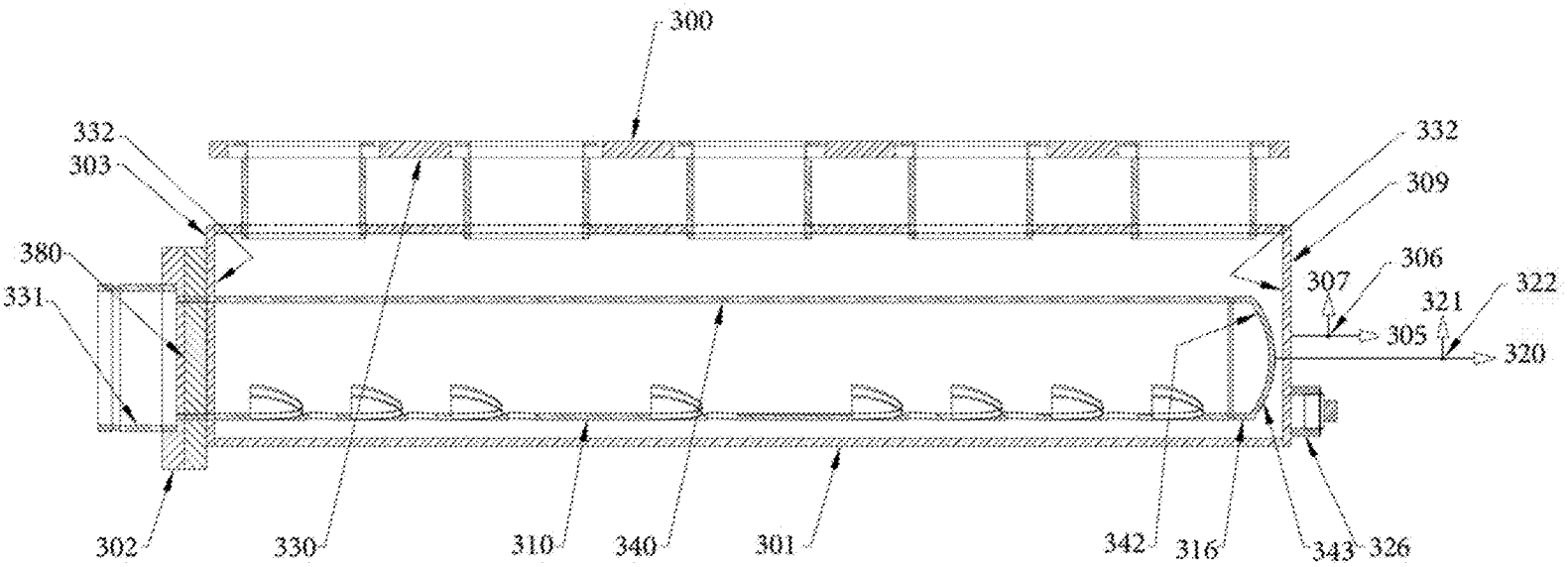
FIG. 3 depicts a cut-away side view of the invention showing its primary elements.
Figure 4:
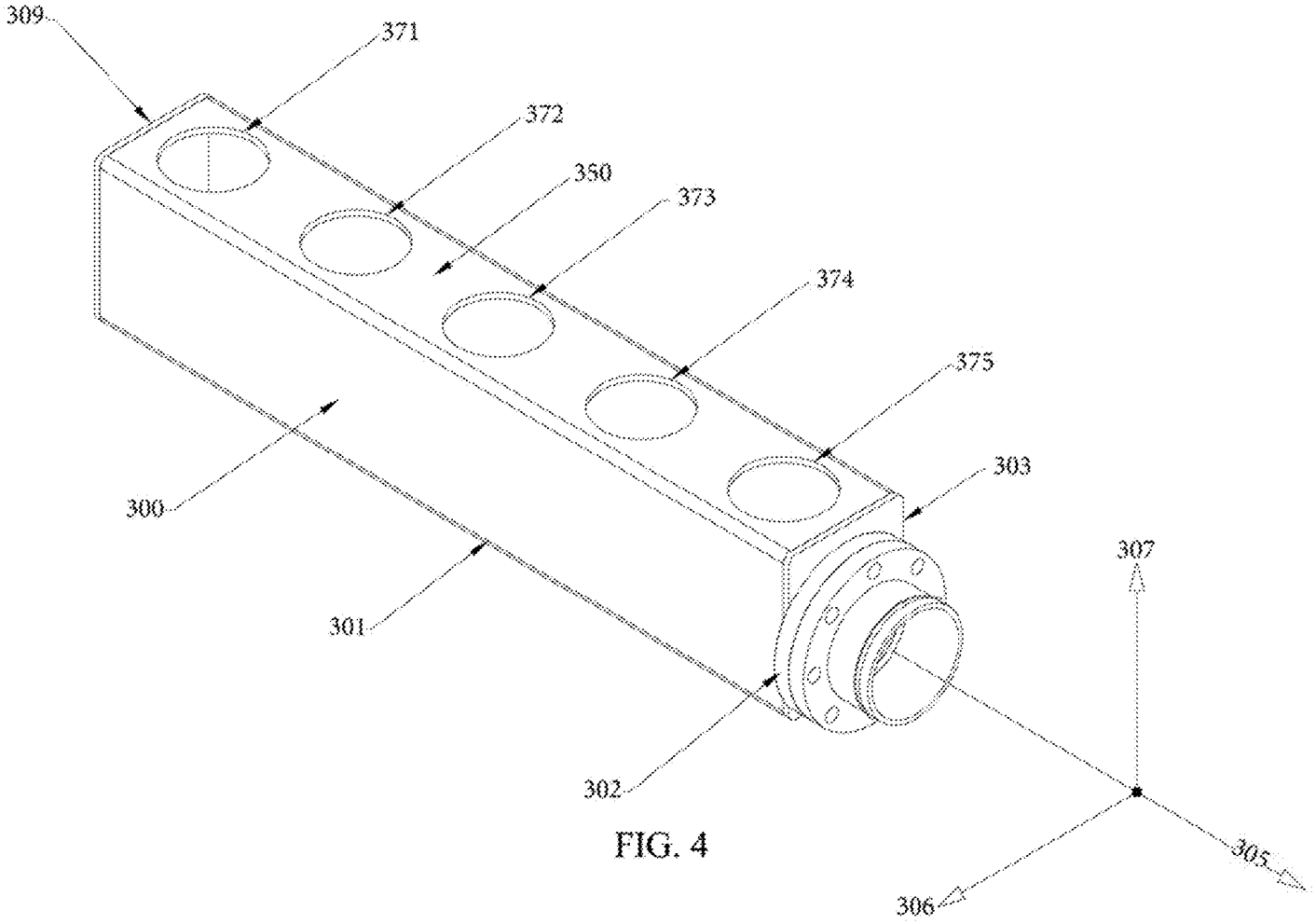
FIG. 4 depicts a perspective view of the rectangular tube of the invention.
Figure 5:
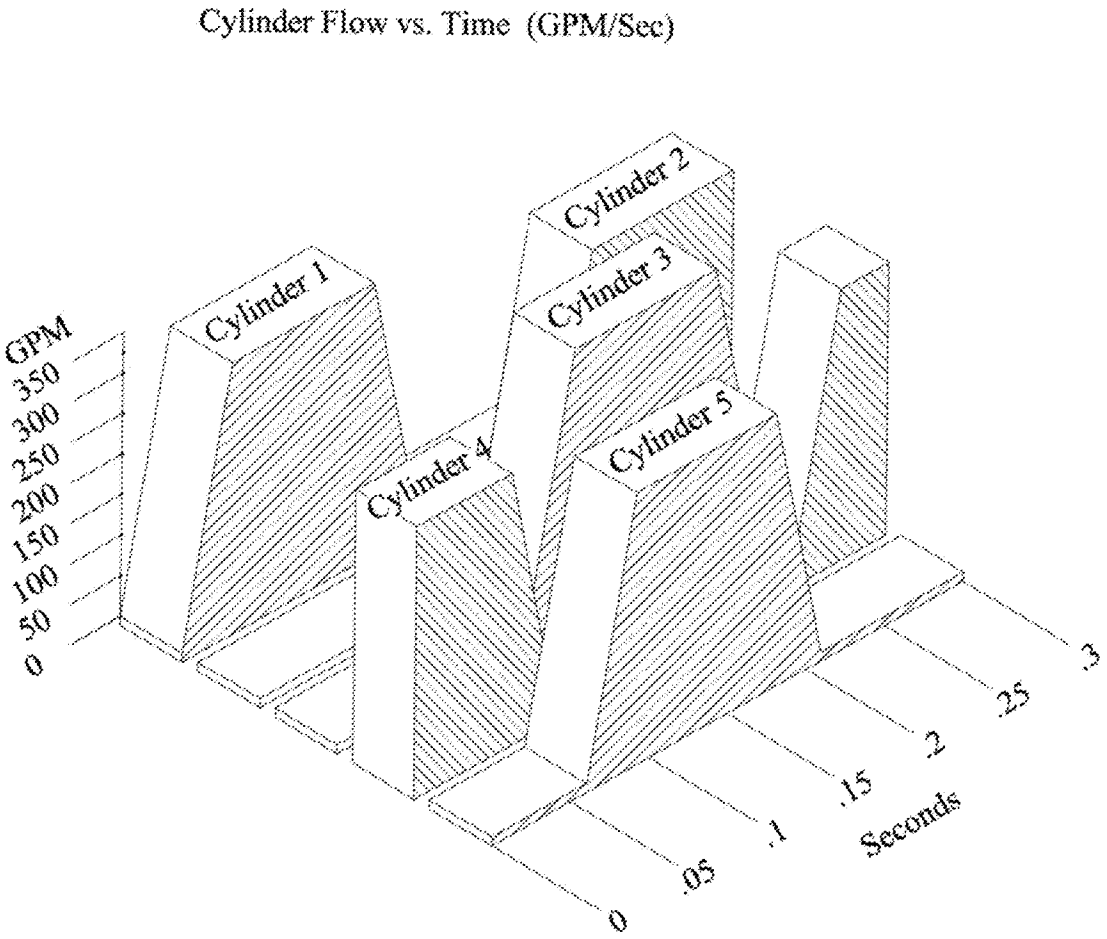
FIG. 5 depicts a graphical representation of flow out of the exit ports of the invention.

Referring next to FIG. 3, a cut-away side view of the invention 300 is depicted. FIG. 3 depicts a cut-away view of the invention 300 in which interior features of the invention 300 are exposed. Referring also to FIG. 4, primary to the invention is an elongate rectangular tube 301. The rectangular tube has a longitudinal axis 305, a vertical axis 307 and a horizontal axis 306 (out of the page in FIG. 4). At one end of the rectangular tube 301, designated here as the proximal end, a flange 302 fixedly attached to a perforated rectangular plate 303 is further fixedly attached to the proximal end of the rectangular tube 301. The rectangular plate 303 is sized to the vertical and horizontal dimensions of the rectangular tube 301. The perforation of the rectangular plate 303 is comprises a circular hole 380 sized to match the in-flow passage of the flange 302.

On the distal end of the rectangular tube 301 is fixedly attached a second rectangular plate 309 to prevent through flow. Integral to the second rectangular plate may be incorporated a clean out valve 326 of some suitable form. The rectangular tube has an interior surface 330. The flange 302 has an interior surface 331. Perforated plate 303 has an interior surface 332. Plate 309 has an interior surface 333. The interior surfaces 330, 331, 332 and 333 may be coated by known compositions to improve flow of fracking fluids during operations.

Figure 8:
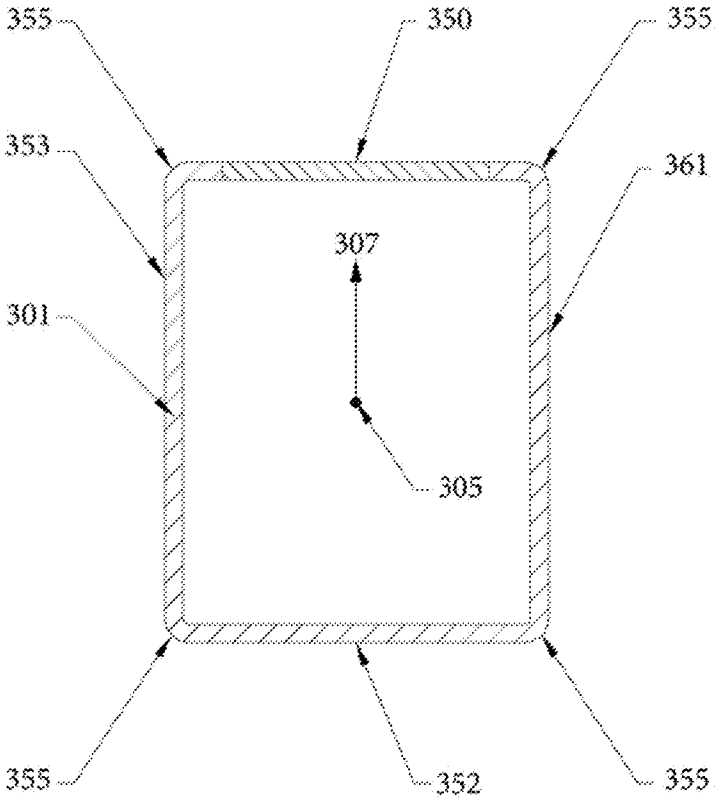
FIG. 8 depicts a cross section of the rectangular tube showing sides and corners thereof.

Referring now to FIG. 8, which depicts a cross-section of rectangular tube 301, rectangular tube 301 has an upper planar surface 350 parallel to the longitudinal axis 305 and in the direction of and orthogonal to the positive vertical axis 307. Rectangular tube 301 further has vertical sides 361 and 353 and bottom 352. Rectangular tube 301 further has four rounded corners 355. The radius of curvature of each rounded corner 355 is designed to improve flow through the invention.

Referring to FIG. 4, which depicts rectangular tube 301 in an orthographic projection, into the upper planar surface 350 are cut circular holes 371 through 375. Circular holes 371 through 375 are centered on an imaginary line parallel to longitudinal axis 305 along the plane imagined by the longitudinal axis 305 and vertical axis 307 through upper planar surface 350. The diameter of each circular hole 371 through 375 is approximately the same diameter as circular hole 380 in plate 303. Referring now to FIG. 3, fixedly attached to each of circular holes 371 through 375 in FIG. 4 are flanged cylindrical exit ports 311 through 315 (each referred to as an "exit port"). The exit ports 311 through 315 allow fracking fluid to exit the invention 300 during pumping operations and pass into the reciprocating pump, not depicted, for well injection.

Referring still to FIG. 3, the invention further comprises a cylindrical tube 310. The cylindrical tube 310 has a longitudinal axis 320, a vertical axis 321 and a horizontal axis 322. The longitudinal axis 320 of the cylindrical tube 310 is parallel to the longitudinal axis 305 of the rectangular tube 301. The vertical axes 321 and 307 are coextensive. The horizontal axes 306 and 322 are parallel. On the distal end of the cylindrical tube 310 is fixedly mounted a cap 316. The cap 316 may he of any suitable shape, but in this exemplary embodiment is hemispherical. The cylindrical tube 310 has an interior surface 340 and an exterior surface 341. The cap 316 has an interior surface 342 and an exterior surface 343. The interior surfaces 340 and 342 and exterior surfaces 341 and 343 may be coated by known compositions to improve the flow of fracking fluids during operations.

All parts are made of sufficiently thick and durable materials to withstand pressures, stresses, temperatures and materials used in fracking operations.

The proximal end of the cylindrical tube 310 is fixedly mounted to the flange 302 such that all fracking fluid pumped into the invention 300 is pumped into the cylindrical tube 310 directly and not directly into the rectangular tube 301.

To mount the cylindrical tube 310 to the rectangular tube 301, cylindrical tube 310 is mounted to perforated plate 303 at circular hole 380. Referring now to FIG. 7, circular hole 380 is centered over the longitudinal axis 320 of cylindrical tube 310. Longitudinal axis 320 of cylindrical tube 310 is parallel to the longitudinal axis 305 of the rectangular tube 301 in the direction of the negative vertical axis 307 of the rectangular tube 301. Therefore, and referring also to FIG. 3, it may be seen that the cylindrical tube 310 is positioned predominantly in the lower half of the rectangular tube 301, as more clearly seen in FIG. 4. Stated otherwise, there is more open space outside the cylindrical tube 310 and inside the rectangular tube 301 in the direction of the positive vertical axis 307 than outside the cylindrical tube 310 and inside the rectangular tube 301 in the negative vertical axis 307 direction.

The position of the cylindrical tube 310 within the rectangular tube 301 relative to the above described longitudinal axes is determined based upon variables relative to a specific pumping operation. Variables may include, but are not limited to, fracking fluid viscosity and pumping rate and may include any variable known in fracking operations.

Figure 6:
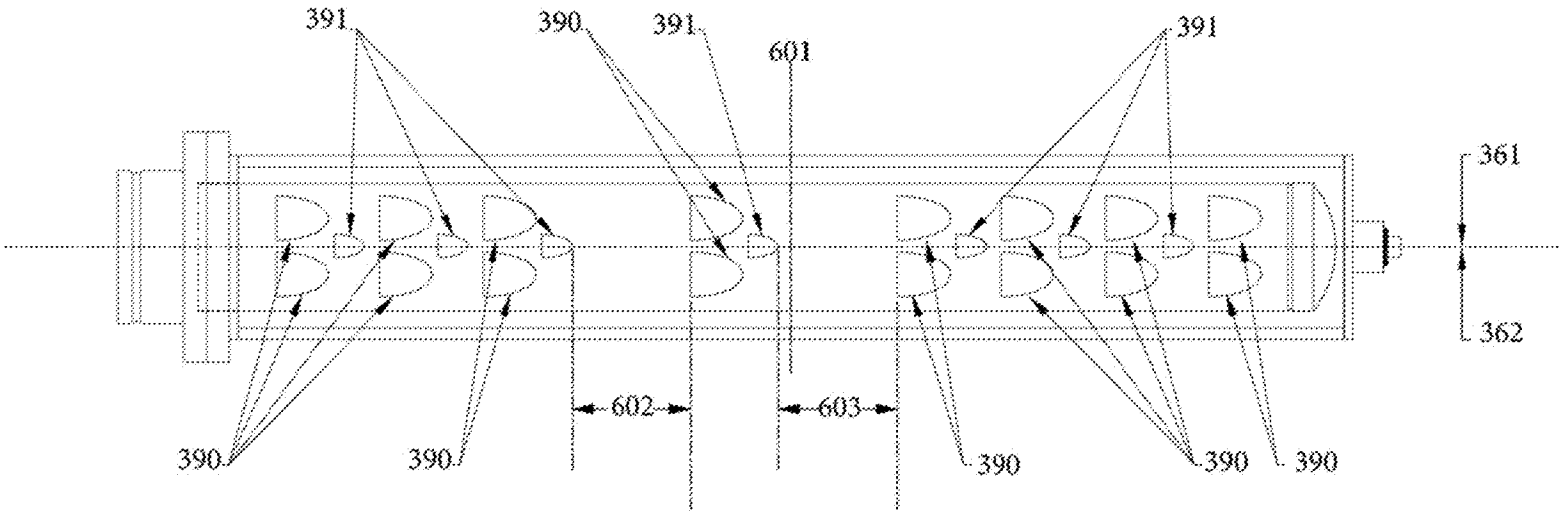
FIG. 6 depicts a bottom view of the invention in which the bottom of the rectangular tube is cut away, further depicting the mixing ports of the cylindrical tube.

Referring to FIG. 6, and referring to upper planar surface 350, the upper planar surface 350 may be bisected longitudinally by an imaginary line 361. Imaginary line 361 is parallel to longitudinal axis 305 of the rectangular tube 301. Imagining further a plane extending outward from the plane created by imaginary line 361 and longitudinal axis 305, a second imaginary line 362 is imposed on cylindrical tube 310. As depicted in FIG. 6, a plurality of mixing ports 390 and 391 are then cut out of cylindrical tube 310 in a pattern along line 362 by the cutting and removal of material comprising cylindrical tube 310. In this exemplary embodiment, seven small mixing ports 391 are cut out of cylindrical tube 310 on second imaginary line 362. Further, in this exemplary embodiment, two sets of eight each large mixing ports 390 are cut out of cylindrical tube 310 parallel to and on each side of second imaginary line 362. Cutting may be by any suitable means.

The specific number, size and positioning of the mixing ports 390 and 391 is determined by operational variables, including fracking fluid viscosity and composition as well as the pumping rate of the fracking fluid and the sizes of rectangular tube 301 and cylindrical tube 310. This determination is made by any suitable means, including computational analysis (e.g. finite element analysis) or experimentation.

Referring still to FIG. 6, a representative plurality of mixing ports 390 and 391 are depicted. In this exemplary embodiment, small mixing ports 391 are approximately the same shape are large mixing ports 390. This shape may be described as approximately parabolic or as a bisected pointed ellipse. Any variation in shape is allowed, including circular, approximately square, approximately rectangular, oval or otherwise. Variations depend on operational parameters. Mixing ports 390 and 391 shapes are limited only to the extent necessary to prevent or reduce the ability of proppant in the fracking fluid from eroding the mixing ports 390 and 391. Therefore, sharp corners are not used on any mixing port 390 and 391 on the downstream end of the flow.

Figure 9:
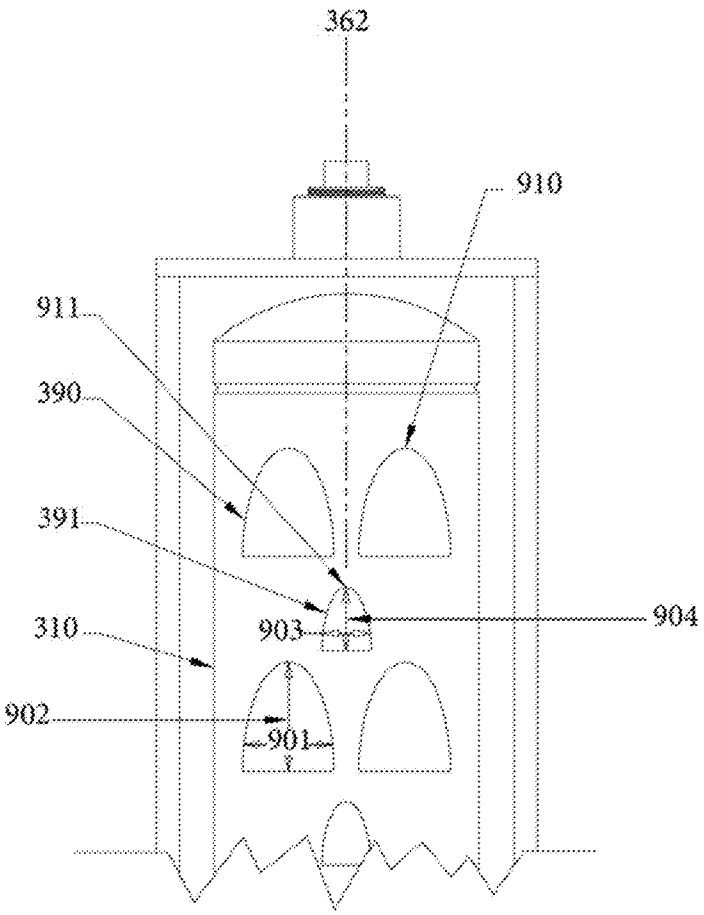
FIG. 9 depicts a detail of the mixing ports.

Referring to FIG. 9, generally, mixing ports will have a size determined experimentally or through use (trial and error). In this representative example, a plurality of large mixing ports 390 and small mixing ports 391 are disposed generally relative to line 362. Large mixing port 390 has a length 902 and a width 901. Small mixing port 391 has a length 904 and a width 903. In operation and in this exemplary embodiment, large mixing port 390 is depicted having a width 901 of 2 inches and a length 902 of two inches. In other embodiments, length 902 may vary from approximately 1 inch to 3 inches, with similar variability for width 901. In this representative example, large mixing port 390 has an approximately parabolic nose 910 and small mixing port 391 has a parabolic nose 911. Parabolic noses 910 and 911 are designed to prevent the funneling of suspended particles in the fracking fluid into a tight corner. Large mixing port 390 is further positioned so that parabolic noses 910 and 911 are in the downstream direction of flow of the fracking Further, in this exemplary embodiment, small mixing port 391 is sized to have approximately ¼ the area of the large mixing port 390.

Referring still to FIG. 9, small mixing ports 391 are cut into the cylindrical tube 310 along the line of second imaginary line 362. A pair of large mixing ports 390 and 390 are cut distal to small mixing port 391 and parallel to second imaginary line 362. Each set of two large mixing ports 390 are cut an equal distance from and on each side of second imaginary line 362.

Referring back to FIG. 6, the positioning and number of mixing ports 390 and 391 are optimized by design as based on operational requirements and parameters. In this exemplary embodiment, imaginary line 601 bisects the longitudinal axis 320 of cylindrical tube 310. Toward the distal end of cylindrical tube 310 are disposed four sets of large mixing ports 390 and three small mixing ports 391. As can be seen, in this exemplary embodiment, the small mixing ports 391 and large mixing ports 390 are spaced in a generally repeating pattern approximately centered on the distal half of the cylindrical tube 310.

Referring still to FIG, 6, four sets of large mixing ports 390 and four small mixing ports 391 are disposed on cylindrical tube 310 in a different pattern on the proximal half of cylindrical tube 310 relative to imaginary line 601. In this exemplary embodiment, two large mixing ports 390 and one small mixing port 391 are disposed just to the right of imaginary line 601. A "gap" 602 is allowed between this set of large mixing ports 390 and small mixing port 391 and the set of distal large and small mixing ports 390 and 391. A similar gap 603 is allowed between the set of large and small mixing ports 390 and 391 disposed closest to imaginary line 601 and a set of large and small mixing ports 390 and 391 on the proximal end of cylindrical tube 310. The set of large and small mixing ports 390 and 391 are disposed on the proximal end of cylindrical tube 310 in a pattern similar to the distal set, although with only six large mixing pods 390.

Figure 10A:
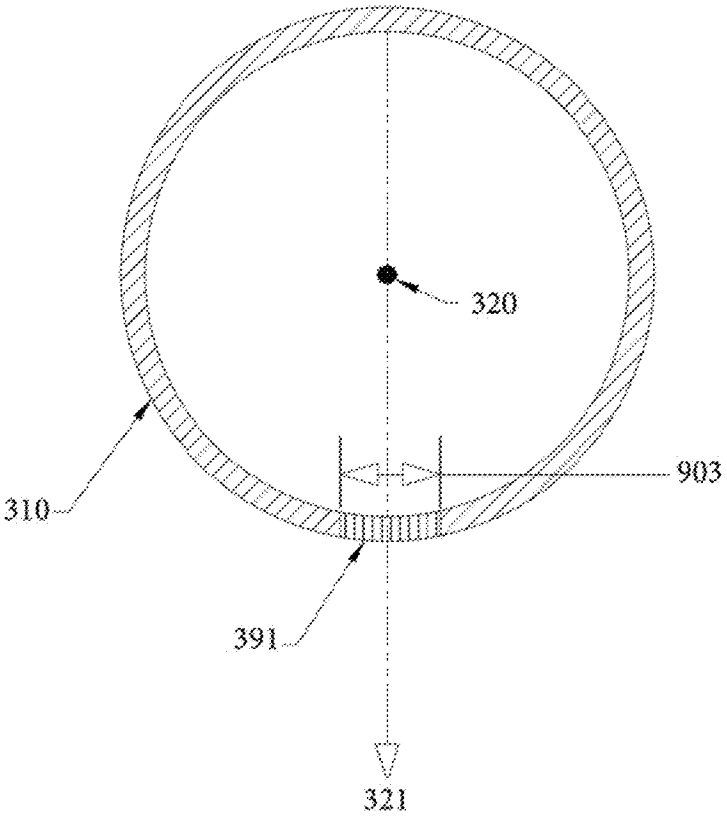
FIG. 10A depicts a cross-section of the cylindrical tube showing placement of a representative small mixing port.
Figure 10B:
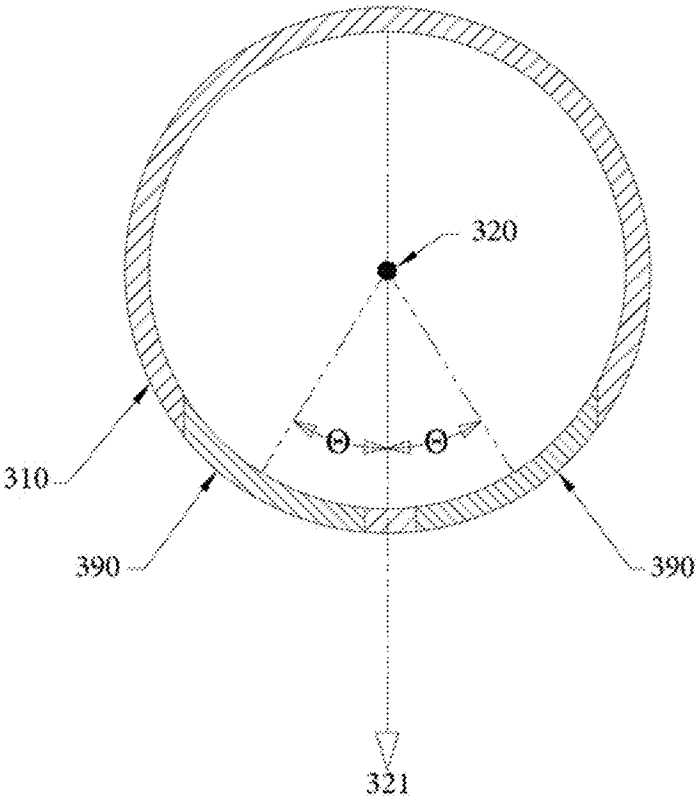
FIG. 10B depicts a cross-section of the cylindrical tube showing placement of a representative large mixing port.

Referring to FIG. 10A, a cross section of cylindrical tube 310 along the longitudinal axis 320 is depicted. The vertical axis 321 in the negative direction is further depicted. In this representative embodiment, a small mixing port 391 is shown positioned directly on and centered on, relative to its maximum width 903, negative vertical axis 321. Referring now to FIG. 10B, a similar cross-section of cylindrical tube 310 along a different position of longitudinal axis 320 is depicted showing two representative large mixing ports 390. The position of the large mixing ports 390 shows bilateral symmetry. The angle of the position of each large mixing port 390 relative to the negative vertical axis 321 is shown as an angle Θ. Θ is determined relative to several factors, including the height and width of rectangular tube 301 relative to the diameter of cylindrical tube 310, the relationship of longitudinal axis 305 to longitudinal axis 320, and the size of mixing ports 390. More specifically, Θ is determined by the need to direct the flow toward but not into bottom corners 355 of rectangular tube 301 depicted in FIG. 8.

Figure 12A:
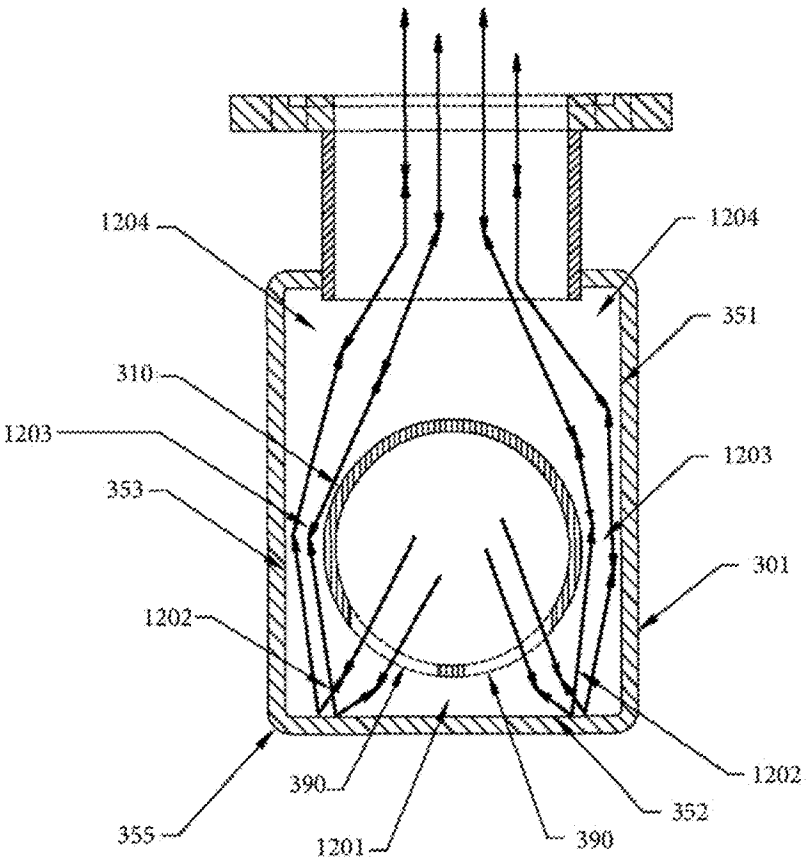
FIG. 12A depicts a cross-section of the invention depicting farther the general flow pattern of fracking fluid out mixing ports set an bilateral angles to the negative vertical axis of the invention.
Figure 12B:
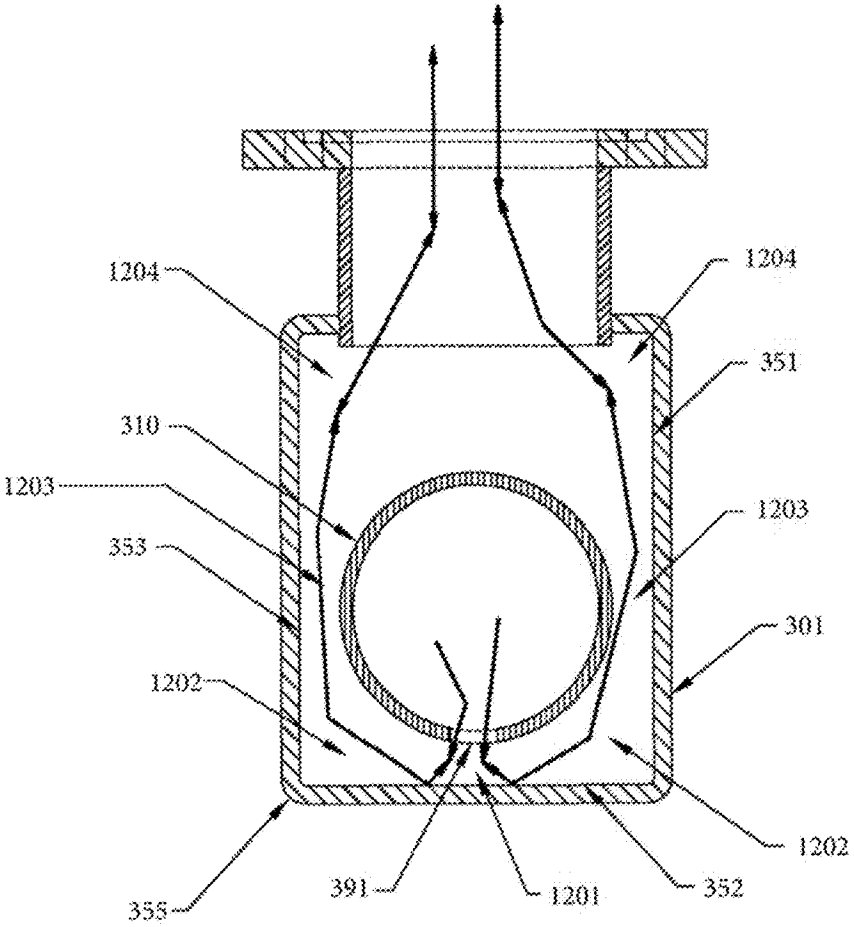
FIG. 12B depicts a cross-section of the invention depicting farther the general flow pattern of fracking fluid out fluxing ports set on the negative vertical axis of the invention.

Referring to FIG. 10B and FIG. 6, by positioning mixing ports 390 off the negative vertical axis 321 by angle Θ, and by placing a larger plurality of mixing ports 390 along the length of cylindrical tube 310 relative to the smaller plurality of small mixing ports 391 and further by sizing large mixing ports 390 larger than small mixing ports 391, the majority of the fracking fluid flows out of the cylindrical tube 310 and into rectangular tube 301 at equal angles in the general direction of the bottom corners 355 of bottom 352. In doing so, the fracking fluid is rolled into the corners 355 to bottom 352 is such a way as to induce turbulence into the flow. Reference is made also to FIG. 12A and FIG. 12B.

The number, pattern, arrangement, size ranges and angles of mixing ports 390 and 391 are not limited to those depicted in FIG. 6. Any suitable number, pattern, arrangement, size ranges and angles are permitted in the invention. For example, three or more sizes of mixing ports may be suitable. Similarly, all mixing ports may be aligned on line 361, or none of them may be, depending on operational requirements. Further, sizes of mixing ports 390 and 391 may be determined generally based on a ratio of the cross-sectional area of rectangular tube 301 to the total area of the mixing ports 390 and 391.

In other embodiments, the position of longitudinal axis 320 of cylindrical tube 310 may be varied relative to horizontal axis 305 of rectangular tube 301, resulting in the cylindrical tube 310 being placed higher or lower within the rectangular tube 301. Further, pressure and speed variations of the fracking fluid pumped into cylindrical tube 310, out mixing ports 390 and 391 and to exit ports 311 through 315 may be varied.

In alternate embodiments, the volumes of rectangular tube 301 and cylindrical tube 310 may be varied. While rectangular tube 301 must always he sufficiently large to allow placement of cylindrical tube 310 fully within rectangular tube 301, all other parameters may be sealable so long as sufficient pressure and flow characteristics exist to create turbulent flow between cylindrical tube 310 and rectangular tube 301. Thus, for example, the diameter of cylindrical tube 310 may be smaller in some applications relative to the height and width of rectangular tube 301 or larger.

In additional alternate embodiments, sensors and gauges to monitor pumping parameters (e.g. temperature, pressure, flow speed, vorticity, vibration, and viscosity) may be added to aid optimization of pumping. Further, injection ports may be added at optimized points anywhere in the manifold to inject specialty chemicals or booster substances to the fracking fluid. Further still, cleanout access ports for the exit ports may be provided. State otherwise, invention 300 may be used in conjunction with all known other technologies in the fracking industry.

In further embodiments, by-pass or flow-through capabilities may be created in the manifold.

Figure 11:
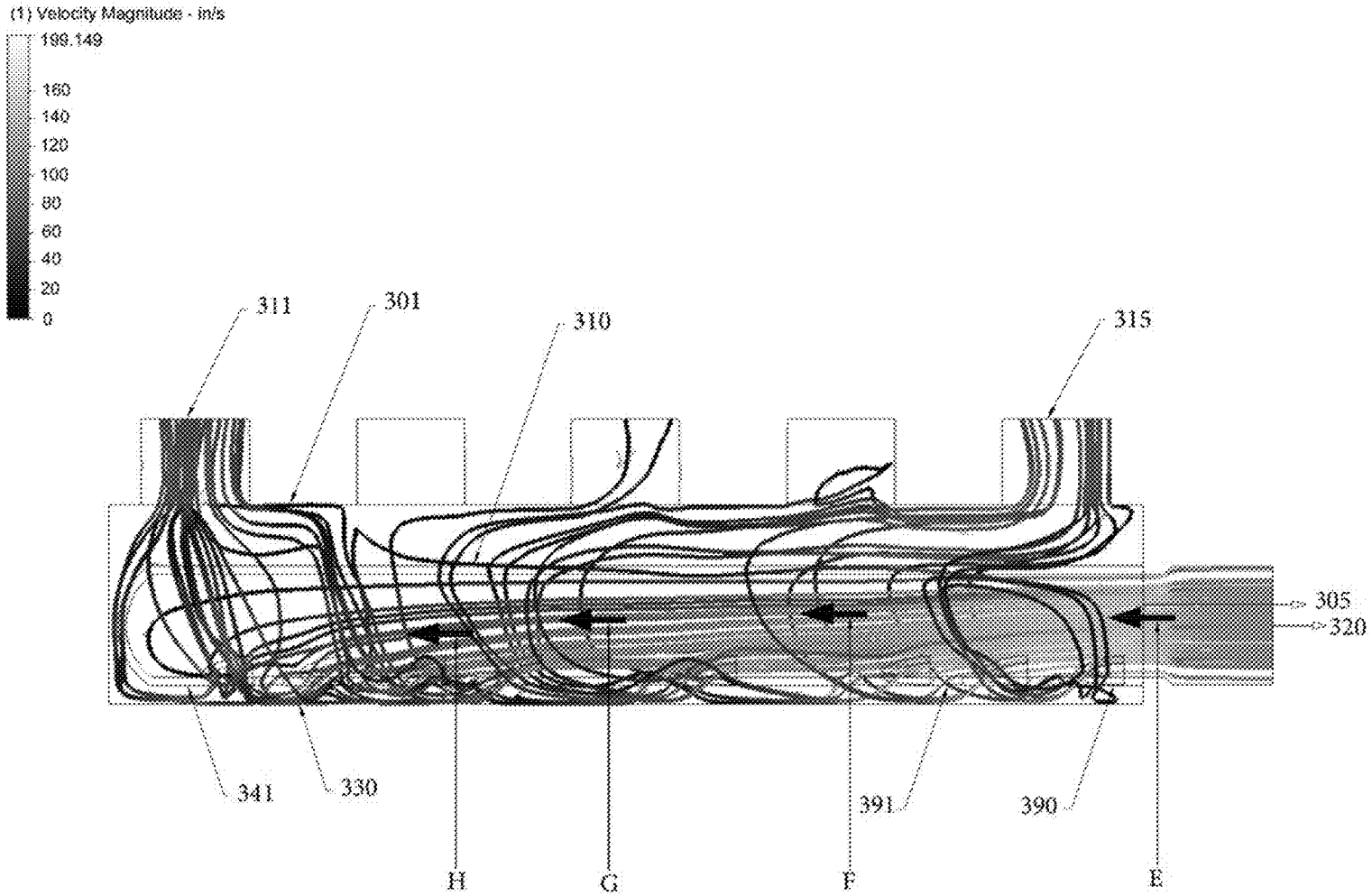
FIG. 11 depicts a representative computational analysis of flow through the invention.
Figure 12C:
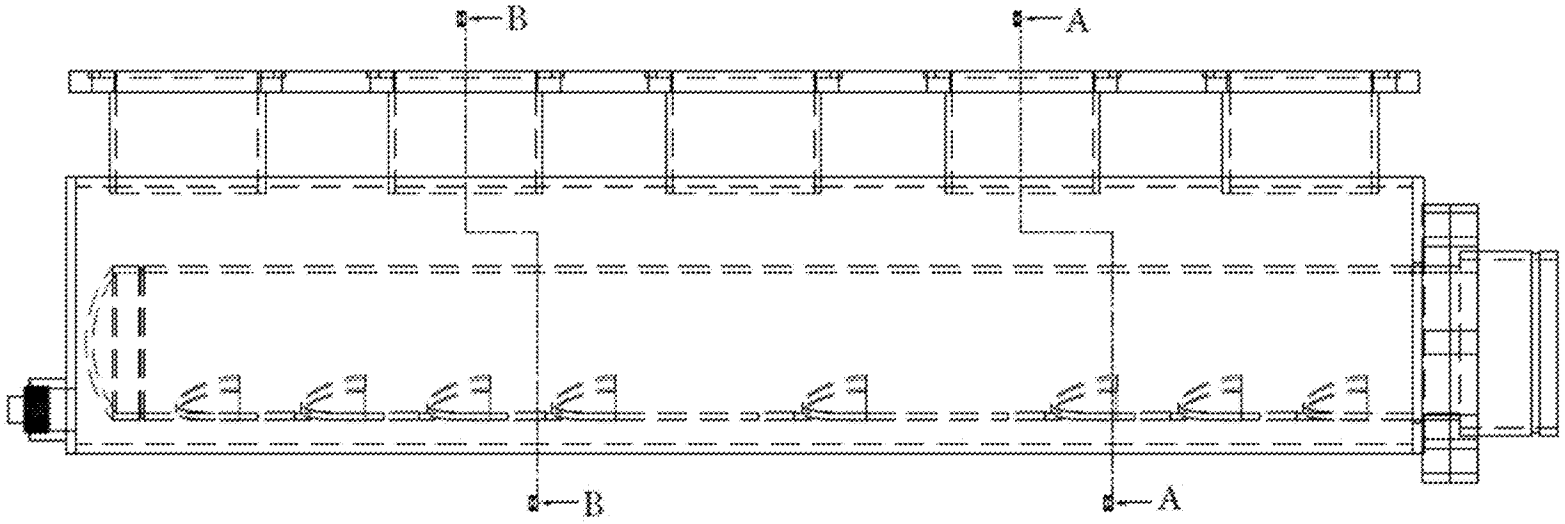
FIG. 12C depicts a longitudinal cross-section of the invention depicting the locations of FIG. 12A and FIG. 12B flows.

Referring now to FIGS. 12A and 12B, idealized paths of particles flowing through the invention are depicted. FIG. 12A depicts a cut-away view of the invention along line AA in FIG. 12C. In this depiction, fracking fluid flows out of bilateral mixing ports 390 toward rectangular tube bottom 352 and in the direction of one of the bottom corners 355. Having contacted bottom 352, particles are directed in the flow upward towards one of the sides 351 or 353 and further upward to an exit port, one of 311 through 315. Referring briefly to FIG. 11, these paths are idealized and do not reflect the turbulence better depicted in FIG. 11. Referring to FIG. 12B, paths of idealized particles exiting through one mixing port 391 are depicted. FIG. 12B depicts a cut-away view along line BB of FIG. 12C. In FIG. 12B, after particles exit mixing port 391, they impinge on bottom 352 and then carried in the flow in the direction of bottom corners 355 and are redirected upward toward one of the exit ports 311 through 315. In this representative example, the different position of large mixing port 390 and small mixing port 391 relative to the negative vertical axis of the invention adds to the instability of the flow in the mixing chamber, primarily 1203 and downstream from there.

It can be seen in each of FIGS. 12A and 12B that fracking fluid flow directions between cylindrical tube 310 and rectangular tube 301 will vary as the fracking fluid flows from the mixing ports to the exit ports. In addition to the different geometries between cylindrical tube 310 and rectangular tube 301, there are areas of open flow and restricted flow. Allowing for turbulence, as shown better in FIG. 11, it remains that the bulk of the flow of fracking fluid is generally vertically from the mixing ports 390 and 391 to the exit ports 311 through 315. Within those general paths, region 1201 (near mixing ports 390 and 391) is more confined, resulting in constricted flow. Immediately thereafter, more open regions 1202 permit flow with lower constriction. Following this, in regions 1203, a narrow passageway constricts flow, increasing flow speed while increasing pressure. Above the cylindrical tube 310 in region 1204, flow restrictions are again reduced. Thus, the fracking fluid is continuously subjected to regions of high and low pressure within rectangular tube 301. Combined with flow instabilities created by the differential flow directions via the orientations of mixing ports 390 and 391, the use of flow constriction promotes turbulence in the fracking fluid, which is helpful to ensure the slurry components are continuously mixed within the manifold until the slurry is delivered to the reciprocating pump for injection to the well.

In practice, the number, patterning, positioning, shape and size of mixing ports are broadly variable. In some operations, fewer mixing ports of a single size and disposed along second imaginary line 362 is optimal. In other operations, equally spaced along second imaginary line 362 large mixing ports, each elliptical in shape, are provided.

Referring now to FIG. 11, flow during an exemplary operation is depicted computationally. Fracking fluid is pumped into the cylindrical tube 310. Referring back briefly to FIG. 2, it was noted that the rate of flow within the cylindrical tube depicted in FIG. 2 drops off quickly. By comparison, it is shown in FIG. 11 that the rate of flow of fracking fluid within cylindrical tube 310 drops off at a generally constant rate through the length of the cylindrical tube 310. Likewise a generally constant level of flow through the mixing ports 390 and 391 is seen along the longitudinal axis (either 305 or 320). Flow rates depicted in FIG. 11 are identified by arrows E, F, G and H. Having exited the cylindrical tube 310, the fracking fluid flows in and through the volume of space bounded between the exterior surface 341 of the cylindrical tube 310 and the interior surface 330 of the rectangular tube 301. Within this volume of space, pressure in the fracking fluid, the viscosity of the fracking fluid, and the different shapes of the cylindrical tube 310 and rectangular tube 301 combine to cause turbulence in the flow throughout the volume between the cylindrical tube 310 and rectangular tube 301 in the negative vertical axis 321 below the longitudinal axis 320 of the cylindrical tube 310. The fracking fluid is then forced under pressure to the positive vertical axis volume area between cylindrical tube 310 and rectangular tube 301. In this region, the larger volume above longitudinal axis 320, turbulent flow is reduced. However, the amount of time the fracking fluid stays in this region is not long enough to allow fracking fluid components to settle out or stagnate.

Likewise, FIG. 11 further depicts an absence of null flow regions in the volume between cylindrical tube 310 and rectangular tube 301, as compared to a significant level of null flow depicted in FIG. 2.

The rate of flow combined with the turbulence in the flow and absence of null flow regions ensure the constituents of the tracking fluid remain mixed until the tracking fluid is transported to the reciprocating pump connected fluidly to exit ports 311 through 315.

It is further seen that the generally constant rate of flow within the volume of space between cylindrical tube 310 and rectangular tube 301 provides consistent flow through the exit ports when open. Referring still to FIG. 11, the rate of flow depicted in the computational analysis through exit port 311 is approximately the same as through exit port 315 in this representative example with two exit ports open. By this, the risk of cavitation and disruptive vibration is significantly reduced.

We claim:

1. An apparatus for the static mixing of solid and liquid slurry components comprising a cylindrical tube for conveying slurry components along the length of the interior of the apparatus, in which the cylindrical tube is open at one end to permit the in-flow of slurry components and capped at the other end of the cylindrical tube, in which the cylindrical tube is disposed along the entire interior length of a rectangular tube, in which the longitudinal axis of the cylindrical tube is parallel to and below the longitudinal axis of the rectangular tube, in which the rectangular tube is capped at each end to prevent outflow from its end, in which the cylindrical tube has disposed thereon a plurality of mixing ports oriented to direct the flow of slurry components at a predetermined angle against the bottom interior wall of the rectangular tube for static mixing of slurry components in the space between the cylindrical tube and rectangular tube, and in which a plurality of exit ports are disposed on the top of the rectangular tube to permit the outflow of mixed slurry components from the apparatus.

2. The apparatus of claim 1 in which the plurality of mixing ports of the cylindrical tube direct the flow of slurry components uniformly along the length of the cylindrical tube and into the rectangular tube at one or more angles toward the interior bottom of the rectangular tube.

3. The apparatus of claim 1 in which the position of the longitudinal axis of the cylindrical tube relative to the longitudinal axis of the rectangular tube may be increased or decreased to place the cylindrical tube closer to or further from the bottom interior wall of the rectangular tube.

4. The apparatus of claim 1 in which the space between the outside of the cylindrical tube and the inside of the rectangular tube further comprises a series of high pressure and lower pressure regions relative to the flow of slurry component.

5. The apparatus of claim 1 in which the plurality of mixing ports disposed on the cylindrical tube are the same size.

6. The apparatus of claim 1 in which the plurality of mixing ports disposed on the cylindrical tube are at least two sizes.

7. The apparatus of claim 1 in which the angles at which at least some of the plurality of mixing ports disposed at angles on the cylindrical tube are at a large angle relative to the bottom of the apparatus.

8. The apparatus of claim 1 in which the angles at which at least some of the plurality of mixing ports disposed at an angle on the cylindrical tube are at a small angle relative to the bottom of the apparatus.

9. The apparatus of claim 1 in which the angles at which at least some of the plurality of mixing ports disposed on the cylindrical tube are in the direction of the bottom of the apparatus.

10. A manifold for the mixing of solid and liquid slurry components comprising a low pressure pump for pumping slurry components to an inflow port fluidly connected to the manifold, a capped inner cylindrical chamber into which the inflow port fluidly delivers unmixed solid and liquid slurry components, which capped inner cylindrical chamber extends the length of the manifold and which cylindrical chamber is defined within a plurality of durable walls of an otherwise generally closed cylindrical shape for containing the flow of slurry components in the cylindrical chamber, a plurality of mixing ports disposed in the durable walls defining the cylindrical chamber and permitting the directed flow of slurry components at a predetermined angle into the bottom interior wall of a generally closed rectangular solid chamber exterior to the durable walls defining the cylindrical chamber, which rectangular chamber is defined within a plurality of durable walls of a generally rectangular solid shape and which further define the body of the manifold, in which the longitudinal axis of the cylindrical chamber is disposed parallel to and vertically below the longitudinal axis of the rectangular chamber, and in which a plurality of exit ports are disposed within a single wall of the plurality of walls of rectangular solid shape defining the rectangular chamber.

11. The manifold of claim 10 in which the plurality of mixing ports disposed on the inner cylindrical chamber are the same size.

12. The manifold of claim 10 in which the plurality of mixing ports disposed the inner cylindrical chamber are at least two sizes.

13. The manifold of claim 10 in which the angle at which at least some of the plurality of mixing ports disposed at an angle on the durable walls of the inner cylindrical tube are at a large angle relative to the negative vertical angle of the manifold.

14. The manifold of claim 10 in which the angle at which at least some of the plurality of mixing ports disposed at an angle on the durable walls of the inner cylindrical tube are at a small angle relative to the negative vertical angle of the manifold.

15. The manifold of claim 10 in which the angle at which at least some of the plurality of mixing ports disposed on the durable walls of the inner cylindrical tube are, in the negative vertical direction of the manifold.

16. A method of mixing slurry in which slum components are pumped under pressure into a static mixing chamber defined by a generally closed inner cylindrical surface extending the entire length of a generally closed outer rectangular surface in which directed flow out of an inner cylindrical tube impinges angularly on the bottom interior surface of an outer rectangular tube, and comprising the steps of:

pumping slurry components into a cylindrical tube positioned wholly within an outer rectangular tube in which the longitudinal axis of the cylindrical tube is parallel to and below the longitudinal axis of the rectangular tube directing outflow from the cylindrical tube at predetermined angles through a plurality of mixing ports disposed on the walls of the cylindrical tube positioning the cylindrical tube relative to the outer rectangular tube such that the slurry components impinge the inner walls of the outer rectangular tube at least one angle substantially away from the perpendicular in which the geometry of the outer rectangular tube relative to the cylindrical tube causes instabilities to form in the flow of slurry components between the cylindrical tube and outer rectangular tube in which pumping pressure and flow rate of the slurry components results in turbulence in the flow of slurry components, resulting in static mixing.

* * * * *